US005175026A

United States Patent [19]

Bertol et al.

[11] Patent Number: 5,175,026

[45] Date of Patent: Dec. 29, 1992

[54] METHOD FOR HOT-DIP COATING CHROMIUM-BEARING STEEL

[75] Inventors: William A. Bertol; Yoshio Hayashi, both of Wheeling, W. Va.; James B. Hill, Natrona Heights, Pa.; Eisuke Otani, Wheeling, W. Va.; Donald R. Zaremski, Cheswick; John P. Ziemianski, Avonmore, both of Pa.

[73] Assignees: Wheeling-Nisshin, Inc., Follansbee, W. Va.; Allegheny Ludlum Corporation, Pittsburgh, Pa.

[21] Appl. No.: 730,549

[22] Filed: Jul. 16, 1991

[51] Int. Cl.[5] ..... B05D 3/14; B05D 1/18

[52] U.S. Cl. ..... 427/307; 427/320; 427/329; 427/432; 427/434.2; 427/436

[58] Field of Search ..... 427/307, 320, 329, 432, 427/434.2, 436

[56] References Cited

U.S. PATENT DOCUMENTS 4,415,415 11/1983 Zaremski ..... 204/145
4,675,214 6/1987 Kilbane et al. ..... 427/432
4,883,723 11/1989 Kilbane et al. ..... 427/432
5,023,113 6/1991 Boston et al. ..... 427/432

*Primary Examiner*—Shrive Beck
*Assistant Examiner*—Katherine A. Bareford
*Attorney, Agent, or Firm*—Webb, Burden, Ziesenheim & Webb

[57] ABSTRACT

A method of pretreating and hot-dip coating aluminum or aluminum alloys on a chromium-containing steel strip to provide an improved coating comprising annealing final gauge steel strip in an oxygen excess atmosphere to produce a chromium-rich oxide on the surface and thereafter electrolytically descaling the strip in an aqueous salt solution to remove the oxide and to expose a chromium depleted surface of the strip. The strip is then transported to a coating line where it is heated to a temperature at or above the temperature of a bath of aluminum or aluminum alloy. A substantially hydrogen atmosphere is maintained over the bath while the dew point is maintained below minus 35° C. The strip is then drawn through the bath to coat the strip.

9 Claims, 1 Drawing Sheet

METHOD FOR HOT-DIP COATING CHROMIUM-BEARING STEEL

FIELD OF THE INVENTION

This invention relates to a method of continuously hot-dip coating aluminum and aluminum alloys on chromium-containing steels.

BACKGROUND OF THE INVENTION

It is known to form aluminum and aluminum alloy coatings upon steel sheet or strip by hot-dip coating. The processes are many, some comprising a variation of the well known Sendzimir process for galvanizing carbon steel strip. The purpose of providing the aluminum or aluminum alloy coating on the strip is to protect the steel from corrosion. Hence, any hot-dip coating process seeks to minimize uncoated portions of the strip including pinhole bare spots. Moreover, the coating must be tightly adhered to the surface of the steel so that it does not separate during fabrication or use.

As used herein, the terms "sheet" and "strip" are used interchangeably and are meant to include flat rolled products including plate, sheet and strip.

Hot-dip aluminum coated steel exhibits a high degree corrosion resistance to salt and other corrosive atmospheres. Hence, it finds use in various applications including automotive exhaust systems. In recent years, automotive combustion gases have increased in temperature making them even more corrosive. For this reason, there has become a need to increase the high temperature oxidation resistance and salt corrosion resistance by replacing aluminum coated low carbon or low alloy steels with chromium-containing steels, preferably, high formability, aluminum coated stainless steels. Other applications may include power plants and high temperature uses where exposure to severe corrosive environments exist.

While the patent literature contains references to hot-dip coated stainless steels, see for example, U.S. Pat. Nos. 3,378,359; 3,907,611; 3,925,579; 4,079,157; 4,150,178; 4,601,999; and 4,883,723, it is well known that these are more difficult to coat than carbon steels. The ferritic grades of chromium stainless steels are known to be even more difficult than the austenitic grades. It is known that it is especially difficult to coat stainless steels with aluminum-silicon alloys with more than 0.5% silicon. The pure aluminum (ASTM A 463-88 Type 2 coatings) forms a thicker alloy layer than one containing 5% to 11% silicon (ASTM A 463-88 Type 1 coatings). Because the iron-aluminum alloy layer that forms at the surface of the steel strip is very hard and brittle, a thick alloy layer makes the formability of the coated strip even worse. For this reason, Type 1 coatings are preferable, particularly in difficult forming applications.

In Kilbane et al. U.S. Pat. No. 4,883,723, there is disclosed a process for hot-dip coating ferritic stainless steels containing at least 6% chromium and less than 3% nickel with a Type 2 coating. The surface of the steel is cleaned by pretreating to remove oil, dirt, oxides and the like, and then is heated to a temperature near or slightly above the melting point of the coating metal, at least about 677° C. (1232.6° F.), and then is protected in an atmosphere containing at least about 95% by volume hydrogen and a dew point of no more than +40° F. (3° C.). The Kilbane et al. process discloses that it is not applicable to Type 1 alloy coatings.

Other processes for making premium products involve preliminary plating of the stainless steel strip with iron, nickel or iron plus boron to prevent oxidation of the chromium. With these processes, both Type 1 and Type 2 coatings can be applied. While the coated strip has excellent properties, this process is very expensive due to higher capital costs, additional process steps and slower processing.

SUMMARY OF THE INVENTION

It is an object according to this invention to provide an improved process for coating stainless steel with aluminum and aluminum alloys.

It is a further object according to this invention to provide a process for coating ferritic stainless steel alloys with a Type 1 aluminum alloy coating.

It is a still further object according to this invention to provide an economical process for coating chromium-containing steel, particularly stainless steel with aluminum and aluminum-silicon alloys that provides a coating having excellent adherence to the substrate and uniformity and surface appearance exhibiting few, if any, bare spots or pinhole bare spots.

A method is provided for pretreating and hot-dip coating aluminum or aluminum alloys on a chromium-containing steel strip to provide an improved coating. The method includes annealing final gauge steel in an oxygen excess atmosphere to produce a chromium rich oxide, electrolytically descaling the strip to remove the oxide and to expose a chromium depleted strip surface, and heating the strip to a temperature at or above the temperature of a bath of aluminum or aluminum alloy. A substantially hydrogen atmosphere is maintained over the bath with a dew point of below −35° C. (−31° F.) while drawing the strip through the bath to coat the strip surface.

DESCRIPTION OF THE PREFERRED EMBODIMENT

Figure 1:
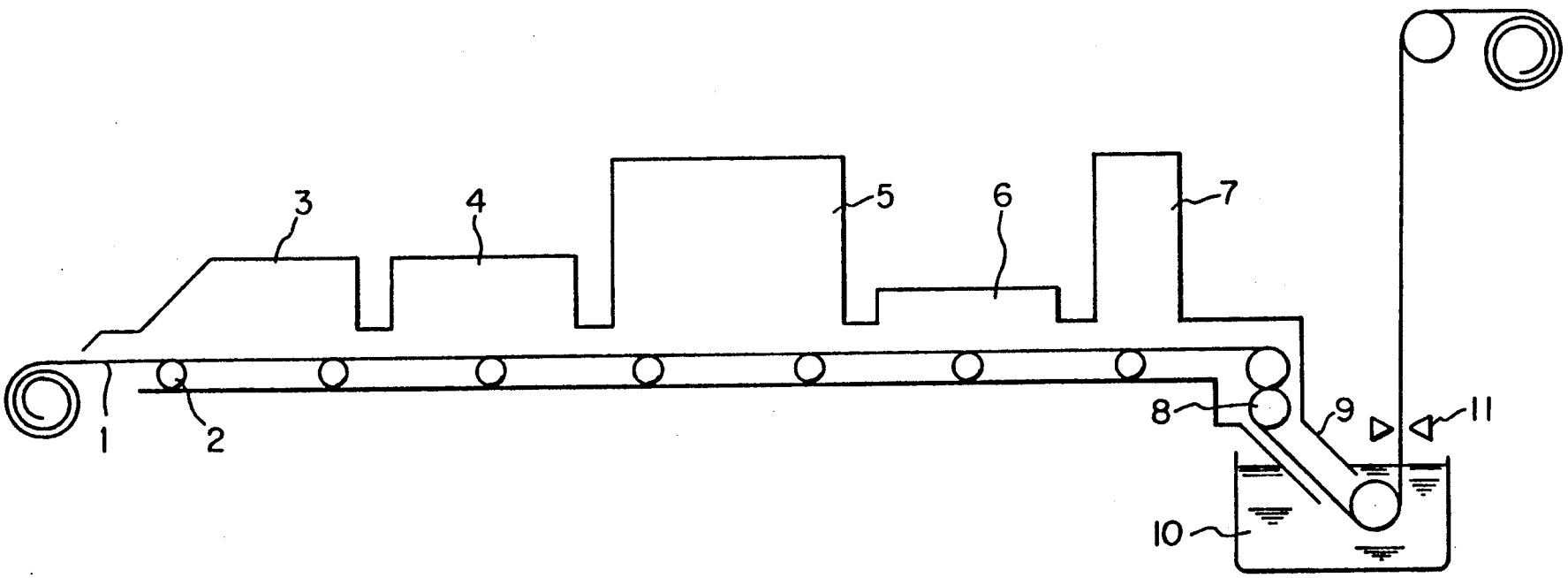
FIG. 1 is a schematic of the coating line.

According to this invention, there is provided a method of hot-dip coating chromium-containing steel sheet or strip in a bath of aluminum or aluminum alloy to provide an improved coating and coated product. By chromium-containing steels, we mean to include steels containing 6% or more chromium and austenitic and ferritic stainless steels. The process is particularly useful with ferritic grades including those containing more than 10% by weight chromium. By aluminum and aluminum alloys, we mean to include aluminum with up to 15% silicon and incidental amounts of iron, chromium, and other metals that will not adversely affect the properties of the aluminum or aluminum alloy coating. In a preferred embodiment, the silicon content of the aluminum alloy comprises between 5 and 11%.

Substrate Surface Preparation

The starting material for the process of the present invention is final gauge sheet which is as cold rolled or cold rolled and annealed. Following cold reduction, the strip may be annealed at temperatures and times required to obtain the desired metallurgical and mechanical properties. The first step of the present invention is an anneal which takes place in an atmosphere carefully selected to produce an oxide on the strip surface rich in chromium spinels for a reason to be explained below and in U.S. Pat. No. 4,415,415. The atmosphere of the annealing furnace should contain excess oxygen on the order of at least 3% and preferably 6% excess oxygen. The anneal for mechanical properties and anneal for oxide formation may be the same anneal step.

The strip is then electrolytically descaled in a salt solution, preferably aqueous solution, to remove the oxide and to expose the depleted chromium at the surface of the strip. Preferably, the salt solution is a sodium sulfate salt solution with a pH reduced to 2-3. It is contemplated that even a neutral salt solution would be effective. The chromium, having been oxidized in the anneal with excess oxygen, tends to be very soluble in the salt solution under the action of electrolysis. The result is that the surface of the strip facing the aluminum or aluminum alloy bath in a following step is enriched in iron and depleted in chromium. An essential feature of the process of the present invention is to provide a chromium-depleted surface on the steel. This can be done by forming chromium rich oxides on the steel surface thereby depleting chromium from the steel surface which results in an increase in iron content at the surface. Chromium depletion is discussed in "Near Surface Elemental Concentration Gradients in Annealed 304 Stainless Steel as Determined by Analytical Electron Microscopy" by Fabis et al., *Oxidation of Metals*, Vol. 25, Nos. 5/6, 1986. With an initial chromium composition exceeding 6% in the steel strip, the electrolysis step will remove the chromium rich oxides resulting in a chromium depleted surface down to a depth of about 2 microns.

It is essential that the chromium depleted layer or region be retained. Generally, any subsequent processing such as acid pickling would be detrimental to the chromium depletion. For example, the strip should not be subjected to a further acid pickling step following the electrolytic salt solution treatment. Otherwise, the chromium depleted surface layer would be adversely affected.

Coating Process

The strip in coil form is transferred to the entry end of a coating line where it is then heated in a nonoxidizing furnace. It will be recognized that other methods of furnace preparation of the substrate material can be practiced. The purpose of this step is to uniformly heat the strip to a temperature the same or higher than the temperature of the molten aluminum or aluminum alloy bath in the most economical manner without changing the character of the surface. Preferably, the strip is heated in a direct fired furnace with an air/fuel ratio less than 0.99 to a temperature of about 600° C.

The strip is then passed to a intermediate soaking stage where the strip is heated by radiant tube burners to temperatures of between 620° C. to 750° C. (1148° F. to 1382° F.) In order to maintain the strip temperature throughout the furnace, the strip is heated to a higher temperature than the coating bath temperature by the radiant tube burners. In this stage, the substantially hydrogen atmosphere is maintained at at least 50% hydrogen with the remainder nonoxidizing gases and preferably the atmosphere is maintained near 100% hydrogen. The nonoxidizing gases should contain only minimal and preferably no nitrogen. This is especially important when coating titanium stabilized steels wherein the nitrogen can result in undesirable nitriding of the steel.

The dew point in the intermediate stage and over the molten bath is maintained below minus 35° C. (−31° F.), preferably below minus 50° C. This is accomplished by proper maintenance of the furnace and snout area and appropriate drying of the incoming gases. Near the end of this intermediate stage, the temperature of the strip is brought to very near the temperature of the bath, for example, by cooling with hydrogen at a temperature of about 200° C. (392° F.) If the temperature of the strip is too far below the temperature of the aluminum bath, an unacceptable coating will freeze on the strip.

The strip is drawn through the coating bath. The operating temperature for Type 1 aluminum is about 650° C. to 680° C. (1202° F. to 1256° F.). The strip speed and the time the strip is in the bath is somewhat variable. Speeds and times typical of other hot-dip coating processes may be used. As the coated strip rises from the molten metal bath, it may be wiped by air jets in the conventional manner.

EXAMPLE

A satisfactory Type 1 aluminum hot-dip coating has been applied to Type 409 ferritic stainless steel by the process disclosed and claimed herein. The AISI specification for Type 409 and the composition of the specific strip coated are as follows in Table I.

TABLE I

| Element | Specification* | Tested Strip* |
|---|---|---|
| carbon | 0.08 maximum | 0.009 |
| manganese | 1.00 maximum | 0.47 |
| silicon | 1.00 maximum | 0.19 |
| chromium | 10.5-11.75 | 11.51 |
| phosphorous | 0.045 maximum | 0.024 |
| sulfur | 0.045 maximum | 0.0006 |
| titanium | 6 × % of carbon minimum | 0.18 |
| nickel | — | 0.18 |
| nitrogen | — | 0.015 |
| iron | balance | balance (and incidental impurities) |

*weight percent

The uncoated strip was cold rolled and had a thickness of 1.29 mm (0.05079 inches). The strip was continuous annealed within a temperature range of 850° C. to 925° C. (1562° F. to 1697° F.) at line speed of about 50 minutes per inch (about 1.97 minutes per millimeter) of thickness at commercial production line speeds in an atmosphere of 6% excess oxygen. This was a combined anneal to effect the mechanical properties and to form the chromium rich oxides on the steel surface. The strip was then descaled by immersing in a sodium sulfate electrolyte solution at 2.0 to 3.5 pH. The specifics of the descaling process are disclosed in Zaremski U.S. Pat. No. 4,415,415 except that the strip was not immersed in a mild acid solution following the electrolytic treatment.

It is believed that portions of other electrolytic descaling processes can also expose the chromium depleted strip surface. For example, a neutral ion electrolyte solution may be used as in the process developed by the Ruthner Corporation of Austria. The Ruthner process includes a final step of post-treatment by immersion in acid which would have to be omitted.

The strip was then heated and hot-dip coated in the apparatus as shown in FIG. 1. A detailed description of the equipment is set forth in an article entitled "Design, installation and operation of Wheeling-Nisshin's aluminizing and galvanizing line", *Iron and Steel Engineer*, November 1989.

With reference to FIG. 1, the strip (1) entered the annealing furnace from payoff reels. The strip was carried through the furnace on hearth rollers (2). The strip first passed through a nonoxidizing furnace (3). This furnace was heated by direct fire gas burners on the sidewalls. The fuel was natural gas burned with an air/fuel ratio of 0.91. The strip temperature in the nonoxidizing furnace reached 652° C. (1205.6° F.) The strip then passed into a radiant tube heating section (4) and was heated by U-shaped gas fired radiant tubes located above and below the strip. The strip temperature in this section reached 749° C. (1380.2° F.) The strip then passed into a first jet cooling section (5) to rapidly reduce the temperature. After passing a soaking zone (6), the strip passed into a second jet cooling zone (7) where final temperature adjustments were made. The strip temperature in the first and second jet cooling sections was 695° C. (1283° F.) and 674° C. (1245.2° F.), respectively. The strip then passed over hot bridle rolls (8) and into a snout (9) leading to the molten bath (10).

Hydrogen was introduced into the snout and the soaking zone. The dew point was maintained below minus 40° C. (−40° F.) as measured in the soaking zone and below minus 70° C. (−94° F.) as measured in the snout.

The strip then passed into a molten aluminum alloy bath (9) (Type 1). The temperature of the bath was 667° C. (1232.6° F.) On emerging from the bath, the strip passed through wiping nozzle 11 and on to water cooling and coiling.

The coated strip was then inspected on both sides for appearance, bare spots, adhesion (peeling), performance in a severe bending test (180 degrees, ASTM A463, Section 9.2), 120-hour salt spray test (ASTM B117) and other tests. The strip was rated good in all but the severe bending test and the bare spots test in both of which it was rated acceptable.

By way of comparison, in initial tests four other pretreatments to the same strip were performed prior to hot-dip coating under substantially the same conditions. In one case, the strip was electrolytically descaled and pickled in nitric and hydrofluoric acid following the oxidizing anneal. In another, the strip was electrolytically descaled, pickled and then surface ground following anneal. In yet another, the strip was shot blasted without any pickle. In a final case, the strip was bright annealed in hydrogen.

Each of the comparative pretreatments resulted in a coated strip that was unsatisfactory. The electrolytically descaled and pickled strip had poor appearance with rough surfaces at the edges on either face after coating and rated average for bare spots. The electrolytically descaled and ground strip had rough surfaces; an unacceptable number of bare spots and rated average for coating adhesion. Likewise, the strip that was shot blasted had unacceptable surface appearance and a number of bare spots and rated average on coating adhesion. The bright annealed strip had an unacceptable number of bare spots and average surface appearance.

The product made in accordance with the subject invention was also compared with a coated full hard strip and a coated full hard strip which had received a surface grinding treatment. This material was annealed on the aluminize-galvanize line. Both of these comparative tests received a poor rating in the total evaluation based on a poor rating for coating adhesion, bare spots and surface appearance.

Pinhole bare spots were determined by inspection of a square meter of the strip surface on both sides of the strip. If no bare spots were found, the coverage was considered good. If the number of bare spots averaged between and 3, the coverage was considered acceptable. If the average was more than 4 bare spots, the coverage was rated poor.

Although there is no intent to be bound by a theory, there appears to be an explanation for why the present inventive method is useful for hot-dip coating of chromium-bearing steels with both Type 1 and Type 2 aluminum coating, not before achievable by prior art methods. The present method creates preferred chromium oxides which can be removed more easily to provide a cleaner steel surface. Together with a better reducing atmosphere over the bath, then both types of coatings can be successfully applied uniformly, with good adherence and surface appearance.

Having thus described the invention in the detail and particularity required by the Patent Laws, what is desired protected by Letters Patent is set forth in the following claims.

What is claimed:

1. A method of pretreating and hot-dip coating aluminum or aluminum alloys on a chromium-containing steel strip to provide an improved coating, the method comprising:

a) annealing final gauge steel strip in an excess oxygen atmosphere to produce a chromium-rich oxide on the surface, said annealed strip exhibiting desired metallurgical and mechanical properties, b) electrolytically descaling the strip in an aqueous salt solution to remove the oxide and to expose a chromium depleted surface of the strip, c) thereafter heating the annealed and descaled strip having the chromium depleted surface to a temperature at or above the temperature of a bath of aluminum or aluminum alloy, d) maintaining a substantially hydrogen atmosphere over the bath while maintaining a dew point of below minus 35° C., and e) then drawing the strip having the chromium depleted surface through the bath to coat the strip.

2. The method according to claim 1 in which the steel strip contains at least 6% by weight chromium.

3. The method according to claim 1 in which the steel strip contains between 6% and 20% by weight chromium.

4. The method according to claim 1 in which the bath includes 5% to 11% by weight silicon.

5. The method according to claim 1 in which the dew point of the atmosphere through which the strip passes before entering the bath is maintained less than minus 50° C.

6. The method according to claim 1 in which the strip is heated to between 620° C. and 750° C. and then cooled to about the temperature of the bath prior to being drawn through the bath.

7. The method according to claim 1 in which heating the strip is carried out in two steps, the first comprising heating the strip in a first nonoxidizing atmosphere and thereafter passing the strip to a soaking stage where the strip is brought at or above the temperature of the bath through indirect heating.

8. The method according to claim 7 including maintaining a nonoxidizing atmosphere of substantially hydrogen in the soaking stage while maintaining the dew point in said soaking stage below minus 35° C.

9. A method of pretreating and hot-dip coating steel strip containing at least 6% chromium in a molten bath of aluminum or aluminum alloy to provide an improved coating comprising the steps of:

a) annealing the final gauge steel strip in an atmosphere of at least 3% excess oxygen to produce a chromium rich oxide on the surface, b) electrolytically descaling the strip in an aqueous salt solution to remove the oxide to expose a chromium depleted surface of the strip, c) introducing the previously annealed and descaled strip having the chromium depleted surface into the entry end of a coating line, d) heating the strip in a first nonoxidizing atmosphere, e) passing the strip to an intermediate stage where the temperature of the strip is brought at or above the temperature of the bath, f) maintaining a second nonoxidizing atmosphere of substantially hydrogen in the intermediate stage and over the bath while maintaining the dew point of the atmosphere in the intermediate stage below minus 35° C., and g) drawing the strip having the chromium depleted surface through the bath.

* * * * *